US006984129B1

(12) United States Patent
Jordan

(10) Patent No.: US 6,984,129 B1
(45) Date of Patent: Jan. 10, 2006

(54) EDUCATIONAL BASKETBALL GAME DEVICE AND METHOD

(76) Inventor: Kern Jordan, 28 Martin Luther King Dr., Unit 57, Norwalk, CT (US) 06854

( * ) Notice: Subject to any disclaimer, the term of this patent is extended or adjusted under 35 U.S.C. 154(b) by 70 days.

(21) Appl. No.: 10/635,388

(22) Filed: Aug. 6, 2003

(51) Int. Cl.
*G09B 69/00* (2006.01)
*A63B 63/08* (2006.01)

(52) U.S. Cl. ..... 434/248; 434/392; 473/479; 473/480; 473/481; 473/483; 473/433

(58) Field of Classification Search ..... 473/479, 473/430, 481, 482, 483, 447, 433; 434/392, 434/248
See application file for complete search history.

(56) References Cited

U.S. PATENT DOCUMENTS 5,064,195 A * 11/1991 McMahan et al. ..... 473/480
5,305,998 A * 4/1994 Nesbit et al. ..... 473/481
5,358,237 A * 10/1994 Yu ..... 473/480
5,418,517 A * 5/1995 Matherne et al. ..... 340/323 R
5,601,284 A * 2/1997 Blackwell et al. ..... 473/483
5,762,569 A * 6/1998 Hale ..... 473/480
6,389,368 B1 * 5/2002 Hampton ..... 702/179
6,554,724 B2 * 4/2003 Taylor ..... 473/447
2003/0153413 A1 * 8/2003 Wood et al. ..... 473/479

* cited by examiner

*Primary Examiner*—Dmitry Suhol
(74) *Attorney, Agent, or Firm*—Anthony H. Handal; Kirkpatrick & Lockhart Nicholson Graham LLP

(57) ABSTRACT

The present invention provides an educational basketball game device, comprising a backboard which houses cheer lights outlining perimeter, a score display, a target, a hoop, and a sensor, an extendable pole which is made of two parts an upper part and a lower part, and a progress display made of several portions which illuminate game progress, and a baseboard which houses speakers, an extendable foul line and wheels. Also, the present invention provides a method for educating a game of basketball with an educational basketball game device. The educational method incorporates playing of recordings that cheer the player to make a shot, encourage the player to aim at target, motivate to keep practicing and getting the ball in the hoop. In addition, the educational method uses cheer lights to acknowledge success. Additionally, a visual display showing a cheering crowd of fans will light up when a goal is achieved.

13 Claims, 6 Drawing Sheets

EDUCATIONAL BASKETBALL GAME DEVICE AND METHOD

TECHNICAL FIELD

The present invention relates to an interactive educational basketball game device with an extendable foul line having varying length and angle designed to enhance the player's skill.

STATEMENT REGARDING FEDERALLY SPONSORED RESEARCH OR DEVELOPMENT (Not applicable.)

BACKGROUND OF THE INVENTION

The present invention relates to improved educational basketball game devices for children and adults that enhances player aim, builds confidence, and provides performance-based reward. The present invention is an interactive device with an extendable foul line having varying length and angle.

Basketball has moved to the forefront as a favorite pastime for people in the United States. The game has been steadily spreading into neighborhoods and even into individual homes. The availability of readily attachable hoops has made it easy for anyone to have them in or near their home. These devices may be seen attached to fences, placed in driveways, or occupying back and front yards. Some hoops are designed especially for indoor use. Other hang on special hangers designed for doors, while still others can stand alone on their own stand.

Whatever the location, no matter what the size, the pull of the game, the will of the player, and the enthusiasm for the sport is constant. Basketball is a unique game in that it can be either a team or a solo sport. As spring approaches, one may notice an increased number of people outdoors playing basketball. Basketball interests young and old alike with its beat and rhythm.

Given the number of basketball goals have been attached above the garage doors or in other places around the drive way of private homes, basketball is a popular family activity. Also, having a basketball goal in one's backyard attracts players from around the neighborhood. Basketball is a favorite pastime for adults as well. One may notice quiet frequently a gathering around a hoop that is attached to a pole, a tree, or some other structure.

It takes a great deal of dedication and commitment to practice shooting hoops on your own. In fact, more frequently it is the adult player who can keep concentration long enough for a solo game. Young enthusiasts of the sport, on the other hand, are usually drawn to the group activity of a basketball game. In addition, young players often have a short attention span for a solo or group game. This is particularly so with the solitude of a solo game.

Further, the attention span of a young novice to the sport is even shorter than that of a more seasoned player. It is very hard for a child who is just beginning to learn how to play basketball to keep interest to practice making the goal on his or her own.

Many parents know how hard it is for children to keep occupied with whatever game they are playing. Often, one may see piles of toys and games on the floor of children's rooms. In fact, many games just come and go as kids' interest in them dies off quickly.

Thus, as kids become bored with their games they call on parents to keep them occupied. More and more parents have to find new and and alternative ways to entertain their children. More and more parents often wish there were games that would keep their child's interest longer.

Novek, U.S. Pat. No. 5,603,495, describes a "basketball shooting practice device and method of training basketball shooting" which suffers from being limited to "target" practice. The patent discloses a device for mounting on "any place on the rim of the basketball goal". The target face may be positioned on a rim at varying angles with the ground. Also, the target is designed to return to its original position if the goal is made. The disclosed invention is limited to the use of a target for basketball shooting training. The present invention differs in that it contemplates a new device and system for enhancing basketball game skills.

Matherne et al., U.S. Pat. No. 5,418,517, teaches a basketball scoring device.

Zhao, U.S. Pat. No. 6,299,555 B1, discloses a "basketball goal sounding apparatus". The device consists of an audio device which is triggered when a goal is made. The patent aims to inspire athletes to hit the goal with letting out a sound every time the ball goes into the basket.

Hurell et al., U.S. Pat. No. 5,916,048, describes an "illuminated basketball goal and basketball". The patent discloses light sources that may be positioned on the backboard and/or on the ball, or glowing devices for same, which are activated when the ball hits certain areas on the backboard. This device is limited to the use of light on the backboard.

Shortcomings of the prior art are overcome and a novel device and method for teaching basketball skills is disclosed herein.

SUMMARY OF THE INVENTION

The object of the present invention is to provide an educational of basketball practice game for children and adults, including teaching the enhancing of the players aim.

Another object of the present invention is to build confidence in the player by providing feedback cheer and applause.

Still another object of the present invention is to provide performance based reward by keeping score of shots made and the degree of difficulty with which those shots were made.

Yet another object of the present invention is to provide a basketball game which educates a player by utilizing an extendable foul line with varying angle position.

Another object of the present invention is to enhance player's interest in the basketball game by providing a motivational system which promotes the player to the next level according to the national basketball association's accepted scoring methods.

Still another object of the present invention is to provide an educational basketball game, comprising a support base, a pole having an upper end and a lower end, where the lower end of the pole being mounted in the support base and extending upwardly from the support base, wherein the pole is variable in height, a backboard mounted on the upper end of the pole, a hoop mounted on the backboard and oriented to receive a thrown ball, a first score indicating device comprising numerical indicating devices, such as an alphanumeric display, a second score indicating device comprising a plurality of achievement level indicating devices having generally known quality attributes, for example, team names or team logos, which may be selectable by player, a goal detecting device for detecting when a player has scored a goal, and an electronic logic circuitry responsive to the goal detecting device to display a numeric score on the first score indicating device and to display and achievement level on the second score indicating device.

BRIEF DESCRIPTION OF THE DRAWINGS

One or more embodiments of the invention and methods of making and using the invention, as well as the best mode contemplated of carrying out the invention, are described in detail below, by way of example, with reference to the accompanying drawings, in which.

DETAILED DESCRIPTION OF THE PREFERRED EMBODIMENT

Figure 1:
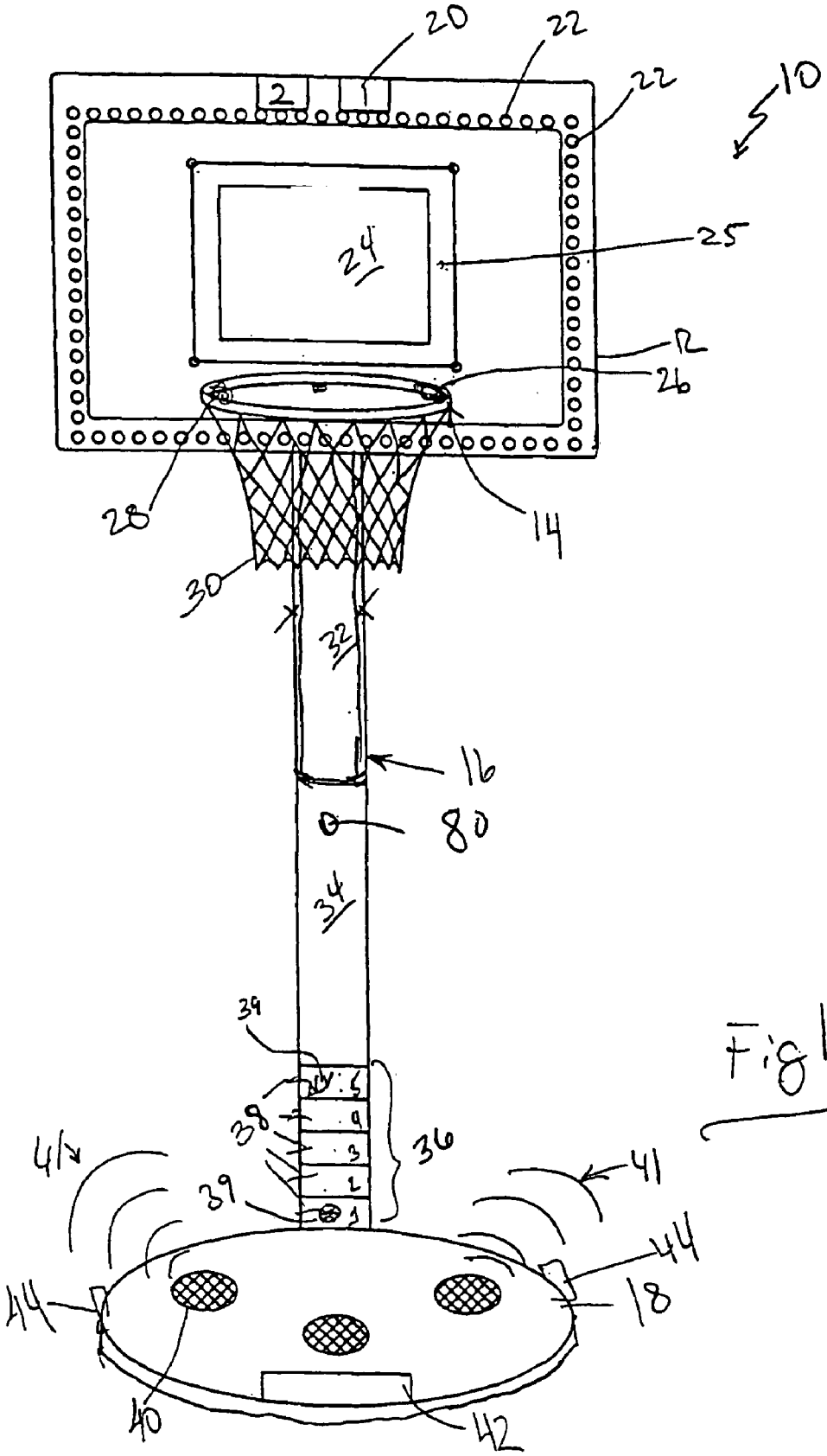
FIG. 1 is a front diagrammatic view of the inventive educational basketball game device constructed in accordance with the present invention.

Referring to FIGS. 1–4 of the present invention relate to an educational basketball game device 10. Educational basketball game device 10 comprises a backboard 12, a hoop 14, a pole 16, and a baseboard 18 which are assembled in a conventional relationship to each other. Pole 16 is extendable, being made of two telescoping sections as discussed in detail below.

Backboard 12 houses a scoring display 20, which is positioned at the top center. Scoring display 20, which may simply comprise a multi-cell backlit translucent plastic panel of lights conventional design, an alphanumeric or numeric display, or the like, is driven by a switch, also of conventional design, which is actuated when a shot is made into hoop 14. Such a switch may be responsive to the application of force to hoop 14, or in particular the application of a downward force to netting 30. Display 20 may display a number corresponding to the number of successful goals.

Figure 5:
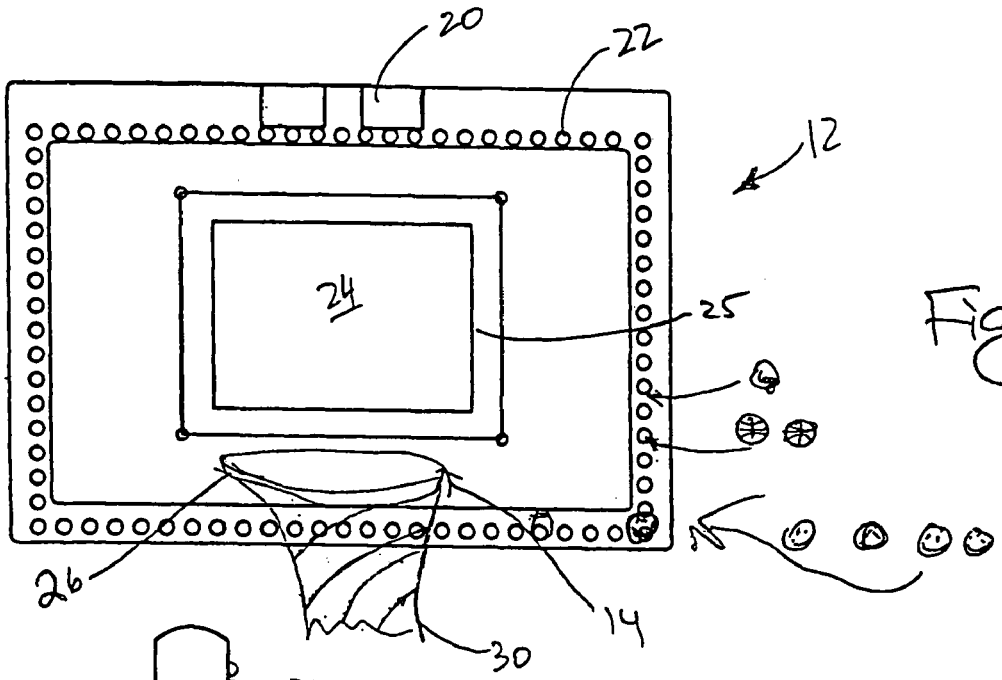
FIG. 5 is front view of a backboard with smiling faces painted on cheer lights.
Figure 2:
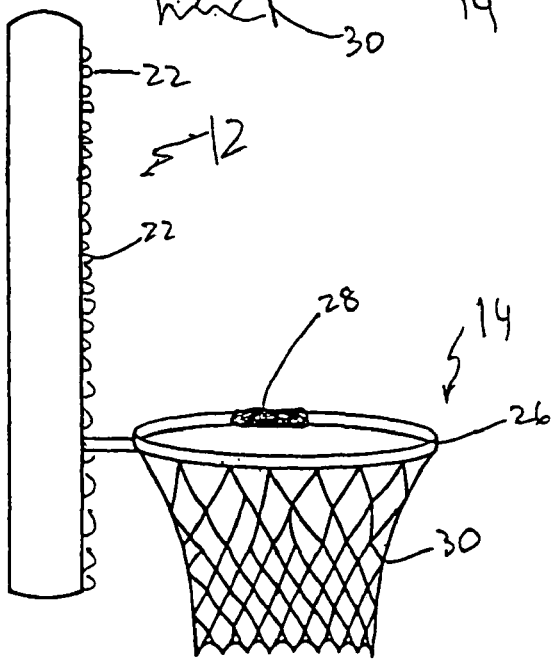
FIG. 2 is a side diagrammatic view of a backboard.
Figure 4:
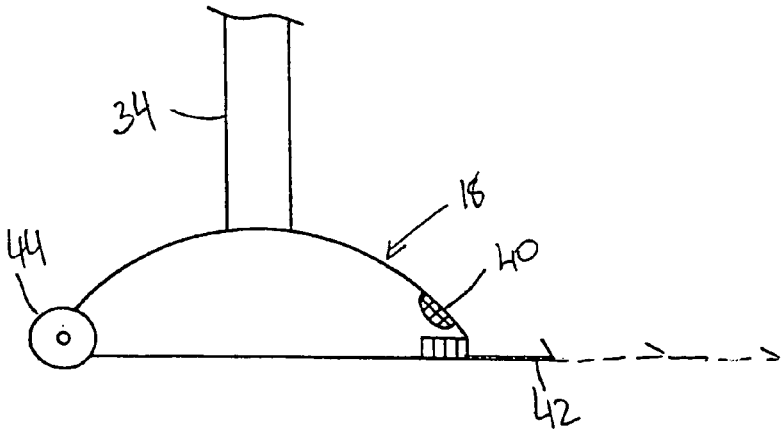
FIG. 4 is a side view of a baseboard.

"Cheer" lights 22 are positioned around the perimeter of backboard 12. Cheer lights 22 light up when a goal is scored. They may blink or be accompanied by a sound accompaniment of the type described more fully below. In an alternative embodiment of the present invention, cheer lights 22 may be made of different colors. For example, red and blue, or neon red, bright white and neon blue. Optionally, cheer lights 22 may light up according to a preset sequence forming a pattern. In yet another alternative embodiment of the present invention cheer lights 22 may have a smiling face, a basketball, or a logo of a basketball team painted on the surface (FIG. 5).

A target 24 is positioned at the center of backboard 12 above rim 26 of hoop 14. Hoop 14 is attached to backboard 12 at the bottom center. Rim sensor 28 is attachedly secured to rim 26 along the inside. Rim sensor 28, in accordance with the preferred embodiment, optionally serves to actuate cheer lights 22. A ball guiding member such as netting 30 is attached to hoop 14 at rim 26 and extends downwardly.

In an alternative embodiment, a visual display 25 will be held in its useful position in the back of backboard 12. Visual display 25 is attached to backboard 12 so that the content of its display is visible to the player through the transparent backboard 12. Backboard 12 will protect visual display 25 from thrown basketballs. Visual display 25 may be of a computer screen type or another kind of display that will light up showing a cheering crowd of fans in response to a detected goal by sensor 28. Lighting up of visual display 25 is coordinated with the cheering sound described below in more detail. The visual stimulation of the player plays an important role in confidence building and is a part of positive feedback routine in the educational basketball game.

Extendable pole 16 is made up of two parts, an upper telescoping section 32 and a lower telescoping section 34. Upper telescoping section 32 is dimensioned and configured to slide into and fit snugly into lower telescoping section 34. Pole 16 thus allows for the inventive educational basketball game device 10 to be adjusted in height in order to accommodate users of different height and skill. It is contemplated that in the alternative, several preset height adjusters will be incorporated into extendable pole 16. For example, basketball gaming device 10 may incorporate calibrations corresponding to heights of four, six, eight and ten feet.

The feature of providing for changing of the height of the hoop provides an economical alternative to having to purchase several different basketball hoop devices for a growing child, or several children. In addition, educational basketball gaming device 10 may be used by different generations or genders of novice and seasoned basketball players residing under the same roof in a single household.

Lower telescoping section 34 supports a progress panel 36. Progress panel 36 is made up of several, for example five or six, displays 38. Each display 38 displays a numeric progress level of the player's performance, as illustrated in FIG. 1. When the player successfully makes a certain number of shots, he or she is granted a positioned at level one and the numeral "1" lights up. As the player's performance continues and the number of successful shots increases, he or she is then moved up succeeding performance levels which are sequentially illuminated.

Figure 3:
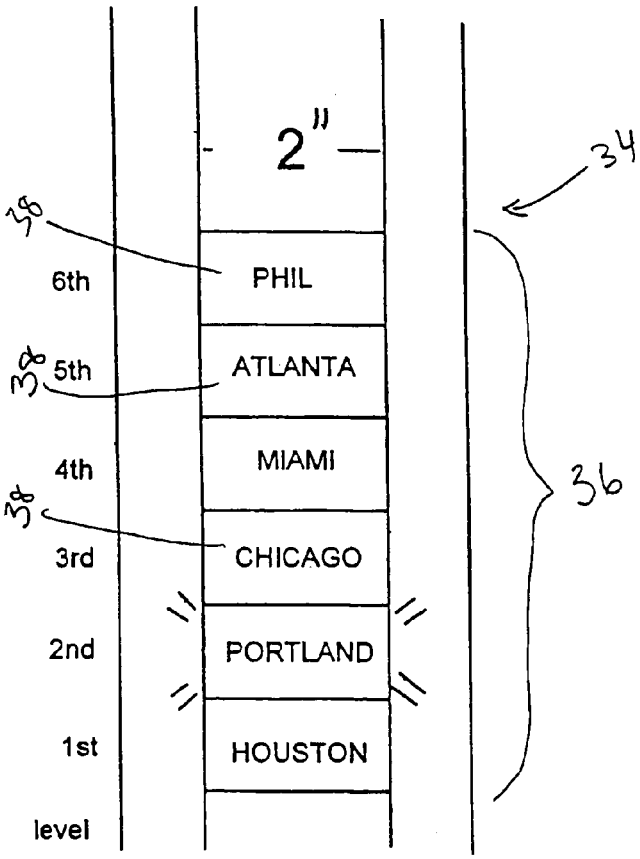
FIG. 3 is a diagrammatic view of a progress panel in accordance with the present invention.

It is contemplated in the preferred embodiment of the present invention that each level will be represented by a well-known basketball team. Each team will be assigned a performance level according to their current National Basketball Association position. Each display 38 will be preprinted with a name of a well-known basketball team or player, as illustrated in FIG. 3. When the player makes a number of goals to satisfy a condition for moving to the next performance level, the corresponding display 38 will light up illuminating the name of the team or the player. The inventive system level display 38 may also include, for example, team logos 39 corresponding to various teams. For example, if Omaha is at the bottom of the standings, when the first few shots are successfully made, the logo for Omaha will light up. If Detroit has the highest steadily, the logo for Detroit will appear in position "5" and will be lit up when the highest threshold number of shots have been successfully thrown by the player. The result is a real world connection which has the effect of boosting interest, attention span and concentration.

Figure 6:
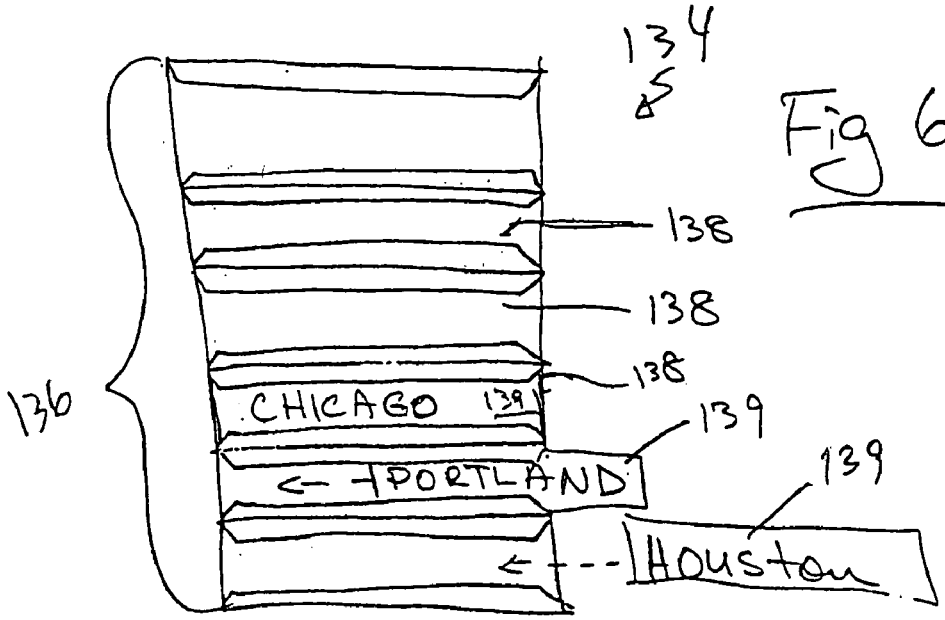
FIG. 6 is a front view of the inventive progress panel with slots and inserts.
Figure 7:
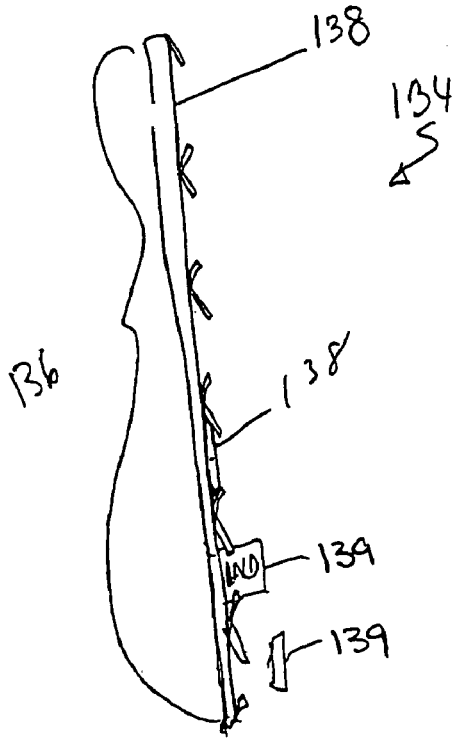
FIG. 7 is a side view of progress panel of FIG. 6.

In an alternative embodiment of the present invention, illustrated in FIGS. 6 and 7, lower pole 134 houses progress panel 136. Progress panel 136 is made up of several, for example five or six, displays 138. Each display 138 is dimensioned and configured to be in a shape of a slot into which translucent backlit inserts 139 with preprinted names of basketball teams or players are inserted. Alternatively, inserts 139 may be blank and the player may write his or her own favorite basketball teams or players. In addition, according to this embodiment, the player may be able to arrange the names of the his or her favorite basketball teams to their liking. The best player or the best team, whatever is the preference, will be positioned at the top of progress panel 136.

Baseboard 18 houses speakers 40, an extendable foul line 42 (optionally connected to a transducer which measures the position to which extendable foul line 42 is extended), and wheels 44. Extendable foul line 42 is marked according to accepted basketball foul line lenghts, optionally scaled down to the size of the inventive game 10, if game 10 is scaled down in size. According to an alternative embodiment of the present invention, foul line 42 is blank and may be distance marked by an individual player.

Figure 8:
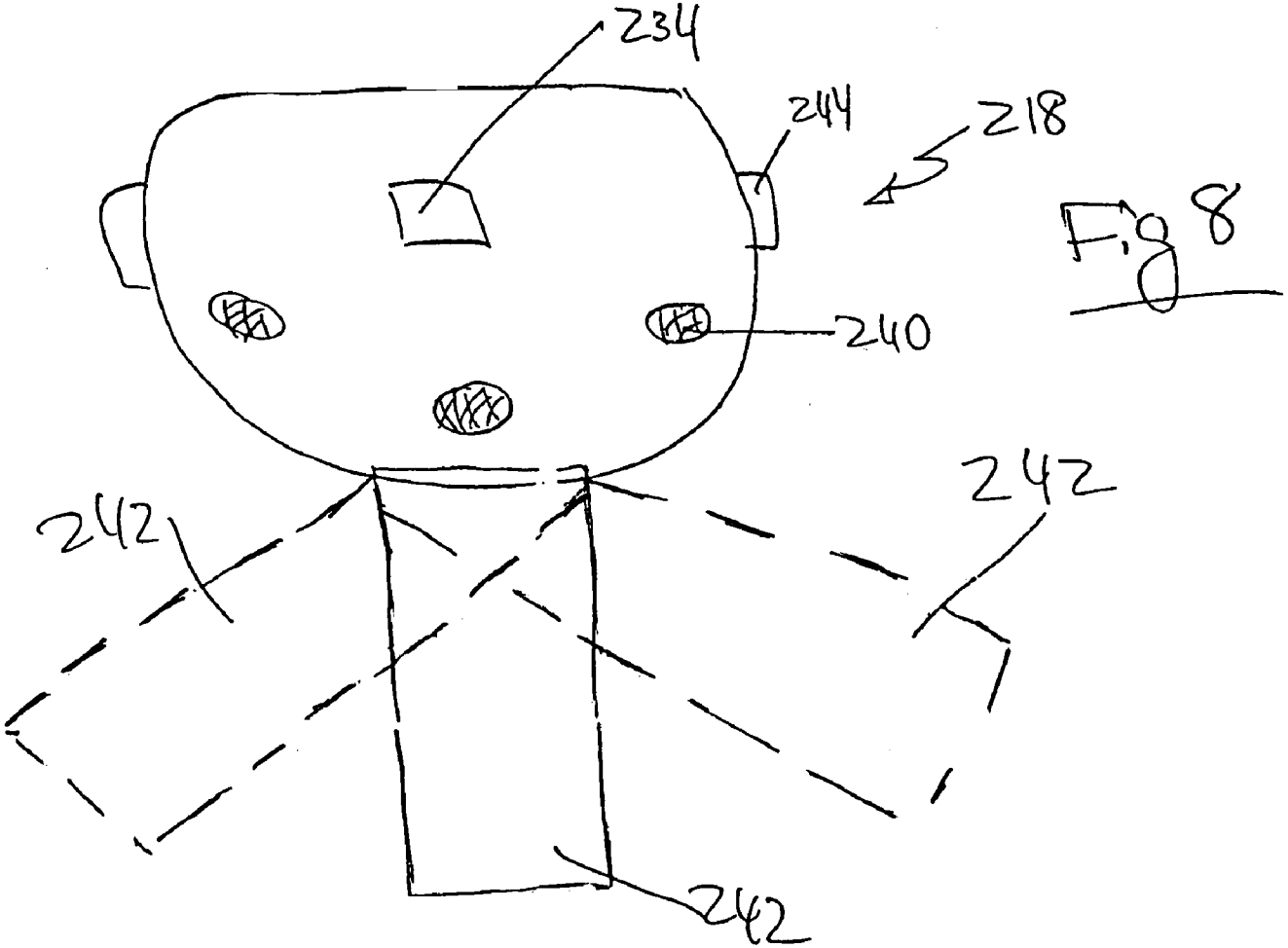
FIG. 8 fails a top view of an inventive game device with a baseboard with varying angle foul line.

In an alternative embodiment, FIG. 8, foul line 242 (optionally connected to a transducer which measures the position to which extendable foul line 242 is extended) has a variable extension angle and may be marked according to accepted basketball foul line lenghts or may be blank and distance marked by the individual player.

Figure 9:
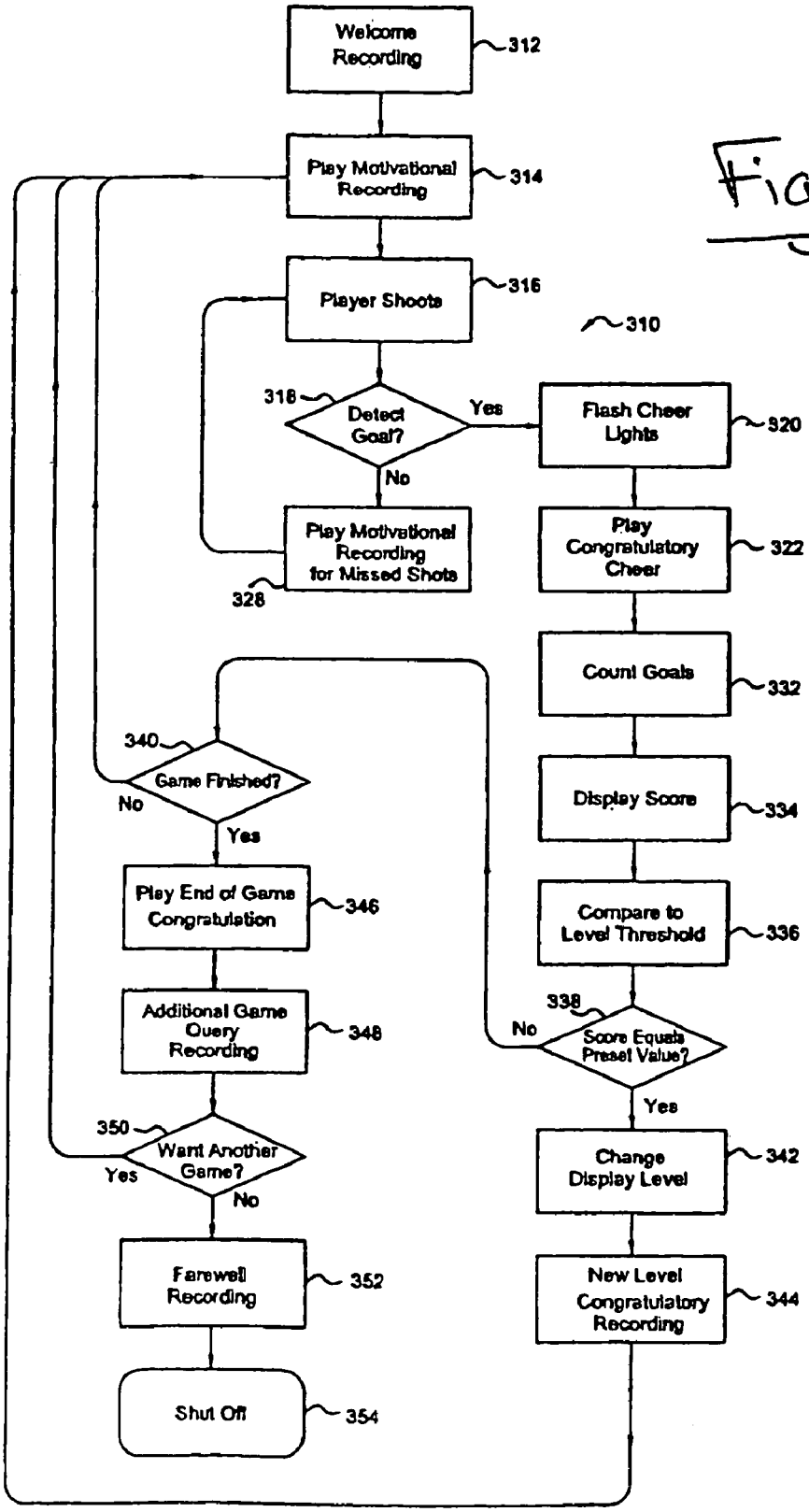
FIG. 9 illustrates a method for educating players in the game of basketball using the inventive educational basketball game device.

A game of basketball is played by first adjusting the height of extendable pole 16 according to the need of a player. Turning to FIG. 9, a method 310 for educating players in the game of basketball using educational basketball game device 10 is depicted.

The inventive method begins with a welcoming recording played at step 312 to set the tone and mood for the game. The welcome recording may include a welcome cheer and may be accompanied by the rules of the game, how it is played, or what to expect in the game. It may incorporate music and narration. In accordance with the preferred embodiment, the system is controlled by a general-purpose computer, programmed multiprocessor, or dedicated computer chip which may be receive inputs from detectors that detect pulling on the net to detect a goal, bouncing of the ball against the hoop, or various parts of the backboard, and the height of the basket.

Then, at step 314, a motivational recording such as another cheer is played. The recording prompts the player to make a shot. The cheer encourages the player to throw the ball into hoop 14. In accordance with the preferred embodiment of the invention, motivational recordings, rules, cheers and the like our heard from speakers 40. The cheer may include a coaching tip, for example, prompting the player to aim at target 24 for a better chance of success. For example it may say: "Go for it! Bouncing off the red target is your best shot!".

It is also contemplated in accordance with the present invention that the coaching tip may be responsive to data collected during a previous shot, for example a plurality of sensors could be put on the backboard of the basketball hoop in order to determine how the player has shot. In order for this to be particularly effective, the player may be instructed to stay in one position, for example, in front, five steps away from the hoop, and try a few shots in a row from that position. This enables the system to adjust the player's shooting from shot to shot.

In another optional feature of the present invention, the recording may prompt the player to adjust foul line 42 according to his level of performance.

The player shoots at step 316. If a goal has been scored, the goal is detected at step 318 when the player makes a shot successfully landing the basketball in hoop 14. This is detected by sensor 28, or a sensor attached to the net. In accordance with the preferred embodiment, it is also necessary to know that a player has taken a shot. This may be done by having a vibration detector associated with the backboard and hoop. Once it is known that a shot has been taken, the system can determine whether a goal has been sunk depending upon whether a second detection of the pulling on the netting is detected. When the vibration is detected, this means that a shot has been taken. If this detection of vibration is followed by the detection of a pull on the netting, this indicates that a shot has been taken and has been successfully sunk in the basket and a goal has been scored.

When the goal is detected, at step 318, cheer lights 22 turn on at step 320, followed by the playing of a congratulatory recording at step 322. The congratulatory cheer sound and/or message is heard from speakers 40. Alternatively, relatively mild cheering can be played when only the hoop has been hit and relatively wild cheering played when a goal has been successfully landed.

Different congratulatory statements may be used at this point, depending on the degree of difficulty of the shot, depending on the distance from educational basketball game device 10, height of pole 16, timing between shots, and the performance level of the player. It is contemplated that several different levels of difficulty may be preselected by the player to initiate a particular sequence of motivational, feedback cheer, and congratulatory recordings.

The system then proceeds to step 332, where the system counts the number of goals. Score display 20 is lighted with the appropriate number at step 334, displaying a numeral corresponding to the number of counted goals at step 332.

At step 336, the system compares the number of counted goals at step 332 to a plurality of preset numbers corresponding to different levels of achievement. The preset numbers are then used at step 336 to evaluate the player's performance and progress, and promote the player to the next performance level. Next the system proceeds to step 338, where the number of goals achieved is compared to the preset amounts. If, at step 338, the player has not proceeded to the next highest preset number, the system proceeds to step 340 for continued to play as will be described below.

However, when the number of goals made by the player equals the next highest preset number, the system proceeds to step 342, where the display 36 is activated in accordance with player level. The first in the series of progress display panels 38 represents the first progress level. To reach the first level, the player will have to make a preset number of goals in to hoop 14. For example, if the preset number of goals is five, then the player will have to sink five goals in hoop 14. When the fifth goal is detected, the player is promoted to the next successive level. The player will have to make five more of the successful shots to be promoted to the next level.

If the player has advanced to the next level, a new level congratulatory recording is played at step 344. The system then returns to step 314 for further play. As discussed above, the new level may be an association with a higher scoring team, or a team of particular importance to the player. The association with the higher level team is a particularly forceful incentive, as compared to the abstraction of a numerical score. The combination of the display numerical score and higher team association, particularly in the case of a sports fan, is a particularly strong motivating force.

In accordance with the invention, it is also contemplated that the players may be able to identify themselves to the system. This allows the system to treat players individually and recognize their individual achievements and compensate for their lack of skill by targeted motivational recordings.

When no goal is detected at step 318, that is when the shot was missed, a motivational recording for missed shots, an encouraging cheer, and/or the like is played at step 328. The player will be encouraged by the recording to keep practicing. Several suggestions on how to improve the player's shot may be played depending on the performance level of the player. For example, the following recording may be played for a novice player encouragement: "You are doing great! Just aim at the red target and you can make that shot!".

The system then proceeds back to step 316 where the above-described sequence is repeated.

At step 340, the system determines whether the number of goals scored comprises a complete game. If this is not the case, the system is returned to step 314.

If, at step 338, the system determines that a new level has not been achieved, the system proceeds to step 340. As noted above at step 340, the system compares the number of goals scored to the number of goals in a game (which is our arbitrary number). If the number of goals scored is less than a full game, the system proceeds back to step 314.

If a number of goals equal to a complete game have been achieved by the player at step 340, the system proceeds to step 346. At step 346, the player is congratulated with the end of a successful game recording at step 346. This is followed by an optional recording at step 348, which plays an optional inviting the player to play another game.

After the invitation to play another game is made by the system at step 348, the player may depress a button 80 to restart the game. Alternatively, if the restart button 80 has not been depressed, the system turns educational basketball game device 10 off after a period of time, for example, thirty seconds, as more fully appears below.

If the system detects that the reset button 80 has been depressed, at step 350 the system returns to step 314 or, alternatively, step 312. Here the sequence is repeated with two exceptions. First the number of points that will trigger the end of game sequence at step 350 is doubled. Likewise, the display of score on display 20 continues to go up from the previous number of goals as goals are scored.

However, if the system does not detect that reset button 80 has been depressed, the system plays a game farewell recording at step 352 and turns itself off at step 354.

In alternative embodiments, educational basketball game device 10 may have several cheer recording sequences stored which play randomly depending on whether the goal was detected. The player therefore here's different cheers and does not get bored with a repeated "canned" prompter.

A timer may be used in an alternative embodiment for counting down the time between each shot. A recording is played prompting the player to make the shot. The coordinated countdown with intensity increasing cheer sequence creates an atmosphere of being at an actual basketball game and being that last hope of your team to save the game. This pressure building routine is very useful for training players to be more prepared for and not to freeze or opt out in an actual basketball game situation where the performance pressure is immense.

Different cheer sequence recordings are contemplated in alternative embodiments of the present invention. For example, the type of recording sequence may depend on the number of players, a solo or a group. For example, the algorithm illustrated in FIG. 9 may be varied to accommodate a number of players selected by the players at the beginning of the game. Also, the type of the recording sequence may be varied to accommodate novice players or the more seasoned basketball enthusiast. Further, a combination of or alternating recording sequences may be played. A recording sequence may contain words, phrases, sounds and combinations of such.

Turning now to FIG. 10, which illustrates an alternative embodiment of the present invention. A backboard 412 which has the features of the preferred embodiment illustrated in FIG. 5 and described above with an addition of a display screen 415. Display screen 415 is positioned in the back of backboard 412 and thus be protected from a thrown basketball. Display screen 415 shows a cheering crowd. Display screen 415 is connected to the electronic logic circuitry and displays a cheering crowd when the goal is detected in coordination with the cheer recordings. This feature enhances the.

While the illustrative embodiment of the invention has been disclosed, it is understood that various modifications will be apparent to those of ordinary skill in the art. Such modifications are within the spirit and scope of the invention, which is limited and defined only by the appended claims.

What is claimed is:

1. An educational basketball game, comprising:

(a) a support base;

(b) a pole having an upper end and a lower end, said the lower end of said pole being mounted in said support base and extending upwardly from said support base;

(c) a backboard mounted on said upper end of said pole;

(d) a hoop mounted on said backboard and oriented to receive a thrown ball;

(e) a first score indicating device comprising numerical indicating devices;

(f) a second score indicating device comprising a plurality of achievement level indicating devices having generally known quality attributes;

(g) a goal detecting device for detecting when a player has scored a goal;

(i) electronic logic circuitry responsive to said goal detecting device to display a numeric score on said first score indicating device and to display and achievement level on said second score indicating device;

(j) a speaker for playing recordings, said recordings being stored in said electronic logic circuitry;

(k) an extendable measuring member, and (l) an extendable measuring member position detector, said extendable measuring member position detector coupled to said electronic logic circuitry, and said electronic logic circuitry generating motivational recordings in response to the output of said extendable measuring member position detector.

2. An educational device as in claim 1, wherein said pole is variable in height.

3. An educational device as in claim 1, wherein said numerical indicating devices are alphanumeric displays.

4. An educational device as in claim 1, wherein said generally known quality attributes are team names and/or team logos.

5. An educational device as in claim 1, further comprising a shot detector, comprising a switch sensitive to vibration of a part of the educational device to determine that a shot has been taken.

6. An educational basketball game as in claim 1, further comprising flashing lights actuated by said electronic logic circuitry in response to the detection of a goal by said goal detecting device.

7. An educational basketball game as in claim 1, wherein said speakers housed in said support base and said motivational recordings vary in response to player successes and failures.

8. An educational basketball game as in claim 1, further comprising a plurality of lights adjacent said basketball hoop, said lights being actuated by said electronic logic circuitry in response to a player achieving a goal, said lights being arranged to be actuated by said electronic logic circuitry to make various patterns.

9. An educational basketball game as in claim 1, further comprising a visual display behind said backboard, said visual display being actuated by said electronic logic circuitry in response to a player achieving a goal, said visual display being activated by said electronic logic circuitry to display a cheering crowd of fans.

10. An educational basketball game, comprising:

(a) a support base;

(b) a pole having an upper end and a lower end, said the lower end of said pole being mounted in said support base and extending upwardly from said support base;

(c) a backboard mounted on said upper end of said pole;

(d) a hoop mounted on said backboard and oriented to receive a thrown ball;

(e) a first score indicating device comprising numerical indicating devices;

(f) a second score indicating device comprising a plurality of achievement level indicating devices having generally known quality attributes;

(g) a goal detecting device for detecting when a player has scored a goal; and (i) electronic logic circuitry responsive to said goal detecting device to display a numeric score on said first score indicating device and to display and achievement level on said;

(j) a speaker for playing recordings, said recordings being stored in said electronic logic circuitry;

(k) an extendable measuring member, and (l) an extendable measuring member position detector coupled to said electronic logic circuitry, and said electronic logic circuitry generating motivational recordings in response to the output of said extendable measuring member position detector, and wherein said motivational recordings are sequenced and selected in order to build the level of pressure to succeed.

11. An educational basketball game as in claim 10, further comprising a plurality of lights adjacent said basketball hoop, said that lights being actuated by said electronic logic circuitry in response to a player achieving a goal.

12. An educational basketball game as in claim 10, wherein upon the detection that a goal has been missed, a motivational recording specifically designed for encouraging a player who was missed the shot is played.

13. An educational basketball game as in claim 10, wherein said motivational recording varies in response to the detection of many missed shots in order to restore player enthusiasm.

* * * * *